United States Patent [19]

Brix

[11] 4,008,676

[45] Feb. 22, 1977

[54] WATER CRAFT HAVING SEA OPENING WITH CONNECTING CONDUIT

[75] Inventor: Joachim Emil Brix, Hamburg, Germany

[73] Assignee: O & K Orenstein & Koppel Aktiengesellschaft, Germany

[22] Filed: Oct. 28, 1975

[21] Appl. No.: 626,329

Related U.S. Application Data

[62] Division of Ser. No. 529,542, Dec. 4, 1974, abandoned.

[30] Foreign Application Priority Data

Dec. 5, 1973 Germany ..... 2360479

[52] U.S. Cl. ..... 114/151

[51] Int. Cl.[2] ..... B63H 25/46

[58] Field of Search ..... 114/147, 148, 151; 115/16, 38; 415/122 A

[56] References Cited

UNITED STATES PATENTS

| | | | |
|---|---|---|---|
| 347,985 | 8/1886 | Babbit | 114/148 |
| 983,078 | 1/1911 | Morten | 114/148 |
| 2,330,674 | 9/1943 | Briggs | 114/151 |
| 3,874,316 | 4/1975 | Lorenz | 114/151 |

FOREIGN PATENTS OR APPLICATIONS

| | | | |
|---|---|---|---|
| 1,177,966 | 3/1962 | Germany | 114/151 |

*Primary Examiner*—Trygve M. Blix
*Assistant Examiner*—Stuart M. Goldstein
*Attorney, Agent, or Firm*—McGlew and Tuttle

[57] ABSTRACT

A water craft has a hull with a cavity communicating with a sea opening below water level. A conduit formation in the hull has one end opening on a side of the hull directly adjacent the sea opening and below water level and is connected through the interior of the hull and has an opposite end which opens into the cavity at a spaced location from the sea opening.

2 Claims, 3 Drawing Figures

WATER CRAFT HAVING SEA OPENING WITH CONNECTING CONDUIT

This is a division of application Ser. No. 529,542, filed Dec. 4, 1974, now abandoned.

REFERENCE TO PENDING APPLICATION

The present invention is an improvement over that disclosed and claimed in application Ser. No. 386,162, now U.S. Pat. No. 3,874,316, filed Aug. 2, 1973. The improvement resides in the discovery that both a cross flow channel having propulsion means therein, as well as a sea chest which opens into the sea below water level may be constructed so as to avoid undesirable flow cavitational effects by connecting conduits formed in the hull into the cavity at a spaced location from its sea opening. The conduits are connected at their opposite ends into the sea below water level directly adjacent the cavity to which it is connected.

BACKGROUND OF THE INVENTION

1. Field of the Invention

This invention relates, in general, to the construction of water craft and, in particular, to a new and useful water craft having a cavity opening to the sea which is connected through a conduit in the hull through an opening below sea level immediately adjacent the opening to the sea of the cavity.

2. DESCRIPTION OF THE PRIOR ART

The present invention has particular application in respect to the construction of ships having cross flow channels or steering channels which are subject to flow disturbances during operation and to methods of improving such flow characteristics. The invention also relates to cavities in the outer skin of the water craft, such as sea chests or sea boxes as well as the cross flow channels for the cross jet steering gear. Sea boxes or sea chests communicate with suction conduits of a cooling water and ballast pumps while in the cross channel, there are provided rotatable devices, such as propellers which produce a thrust for maneuvering the ship. Cross jet rudders are started, particularly during a low or middle speed motion of the ship when the effect of the main rudder is reduced.

Even at low speeds of the ship, flow conditions are produced in the cavities which have sea openings below water level which are undesirable and which interfere with the operation of the ship to the extent that they cause increased power consumption. Thus, for example, whirls which are created in sea boxes impair the delivery of the cooling and ballast water pumps and similar flow conditions in cross flow channels of jet rudders affect not only the thrust and the power consumption of the cross jet rudders but also the ship's resistance. Due to these flow conditions, the propeller of a cross jet rudder is exposed to the inflow in a nonsymmetrical manner and vibrations wear and decreasing thrust with a frequently increasing power consumption are observable, even at low speeds of the ship. The dimunition of the transverse force of a cross jet rudder is due to over- and under-pressure fields which are induced at the outer skin in the vicinity of the deviated jet during the motion of the ship. In order to abate these parasite pressure and suction fields, the concept of pressure equalizing channels has been conceived and successfully introduced into the practice. In order to improve the conditions at the inlet side of the cross jet steering gear, rounds or collar-like shapes of the transition surface in the outer skin of the ship have been provided also.

It has been proved that during a forward motion of the ship, a cross jet rudder can be overloaded, while during a backward motion, as a rule, the power consumption decreases with increasing speed of the ship (BRIX, J.: Model tests with the SCHOTTEL cross jet gear S 500 L, HANSA-STG-Heft 1971; BRIX, J.: Cross jet rudder with pressure equalizing channels A-S-T, HANSA, 18/1972).

Considerable problems arise in the delivery of cooling or ballast water from conventional sea boxes during the travel of a ship. Such problems assumes dangerous proportions at increased speeds of the ship and thereby higher mechanical power outputs result in view of the volume of cooling water which is required. It is very essential that the performance of cross jet rudders be improved particularly for their operation during as ship's travel in estuaries, channels and harbor basis and during travel in fog or in off-shore service where the effectiveness of the main steering device is relatively small.

SUMMARY OF THE INVENTION

The present invention provides an improved device for improving the operation of sea chests and cross flow channels and for improving the hydrodynamic flow conditions and cavities of the ship's hull. The invention provides a seawater connection directly into the channels or sea chest by means of conduits which are defined in the hull and which open into the sea chest and have a connection outside the side of the hull below the water level. Such conduits are located directly adjacent the sea box or cross jet rudder so that their entrances are located in the outer skin of the vessel before the cavity and their exits open into the cavity. Such a system is advantageously arranged so that the flow channels extend in the direction of flow at the location where they are provided. Consequently, such flow channels may extend horizontally or in direction which is inclined relative to the cavity.

Particular local conditions, such as the length of the cross tunnel or the depth of the sea box, may require a curved or varying cross section in the longitudinal extension of the flow channel or channels. In order to reduce the inflow and outflow losses in the transition zones at the outer skin and in the cavity including the sea chests, as well as the cross tunnels, rounded faces are provided at the entrances.

To simplify the construction and avoid subsequent structural changes for establishing the flow channels, a cross tunnel of a cross jet runner may be manufactured from the beginning with two or more flow channels such as a so-called K-channel or with longitudinally curved parts, such as in a C-channel. The use or two or more connecting conduits into the sea chest or the cross jet runner results in the induction at the outer skin of a pressure or suction field such as in a conventional cross jet rudder arrangement. The undesirable pressures in suction fields can be eliminated by one or more passively effective pressure equalization channels which are disposed behind the cross jet rudder system in the travel direction and extend from one board wall to the opposite board wall. The advantage obtainable with the invention is that the undesirable flow conditions in the cavities of the outer skin, in particular, sea chests and in cross tunnels of cross jet rudders can be eliminated. Therefore, the deliveries of the cooling- and ballast-water pumps and the thrust of the cross jet rudders are considerably increased and, the overload phenomena are prevented. The inventive idea can also be interpreted as an improvement of the intake side conditions of the fluid flow engines with an oblique or nearly oblique admission. With an appropriate configuration of the cavities in flow channels, even a reduction of the ship's resistance is possible. On the other hand, and without the flow channels of the invention, the hull's resistance would be increased due to the damming effect at the rear edge of the cross tunnel or the cavity.

Accordingly, it is an object of the invention to provide a water craft which has a hull with a cavity with a sea opening below the water level and which includes a conduit formation in the hull having one end opening into the cavity and the other extending outwardly to the side of the hull directly adjacent the cavity and opening therein below sea level.

A further object of the invention is to provide a hull which is simple in design, rugged in construction and economical to manufacture.

For an understanding of the principles of the invention, reference is made to the following description of typical embodiments thereof as illustrated in the accompanying drawings.

GENERAL DESCRIPTION OF THE PREFERRED EMBODIMENTS

Figure 1:
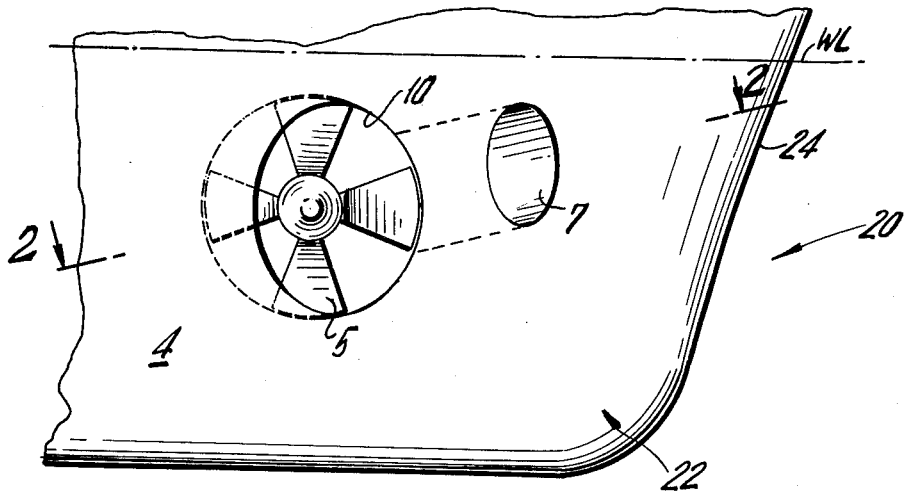
FIG. 1 is a side elevational view of a vessel having a connecting conduit for a cross flow channel constructed in accordance with the invention.

Referring to the drawings, in particular, the invention embodied therein in FIG. 1 comprises a vessel generally designated 20 which includes a hull 22 having a cross channel or steering channel 10 which extends completely through the hull adjacent the bow 24 and which is located below the water level WL. The duct 10 extends from one side 3 to the opposite side 4 of the hull and propulsion means in the form of a drive motor 26 which drives propeller 5 is located within the central area 1 of the duct 10. The propeller 5 is rotated by the motor 26 in order to produce a desired flow through the duct 10, for example in the direction indicated by the arrows 30. Normally, a whirling turbulent flow would form behind the front edges of the tunnel inlet and the tunnel outlet at the forward ends at locations 6 and 6', respectively. This flow would hinder the inflow to the propeller 5.

In accordance with the invention, however, one or more conduits or flow channels 7 are defined in the hull 22 and they have their inner ends connected into the cavity 1 defined by the duct 10 and their outer ends extend directly to the side of the hull 22 directly adjacent the associated inlet or outlet to the cavity 1. The ducts insure that the turbulence immediately ahead of the inlet 6 and the outlet 6' are eliminated and that the flow conditions through the duct 10 are vastly improved. In addition to this, the flow channel duct is also curved from the bow inwardly and rearwardly toward the center of the duct 10 and then outwardly and forwardly to the outlet on the opposite side wall 4.

Figure 2:
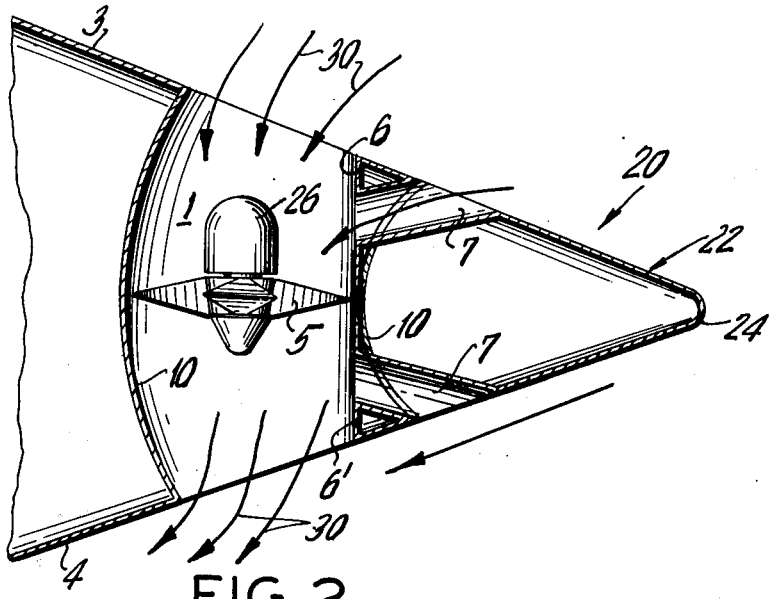
FIG. 2 is a horizontal sectional view of the bow portion of the vessel shown in FIG. 1.
Figure 3:
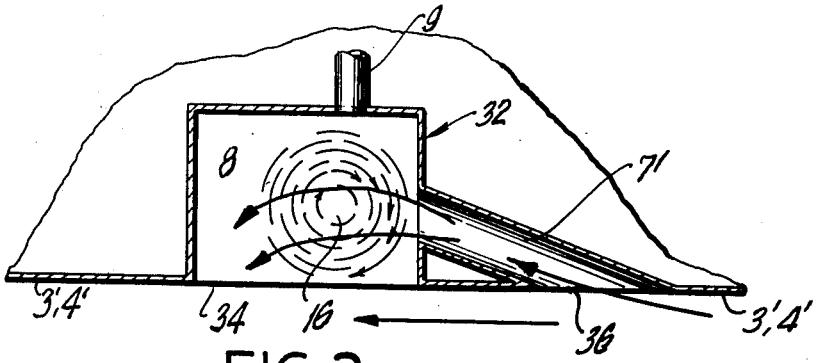
FIG. 3 is a view similar to FIG. 2 of another embodiment of the invention.

In accordance with the feature of the invention, the cavity which is involved may comprise either the cavity 1 formed in the duct 10 or a cavity 8 formed in a sea chest or sea box generally designated 32 as shown in FIG. 3. The sea box 32 provides an outlet connection with an outlet opening 34 directly into the sea on the side wall 3' or a side wall 4' as desired. The connecting conduit 9 for the sea box 32 opens into the interior cavity 8 and without any further connections, there would be a tendency for a whirling stream such as the whirl portion 16 to form within the sea box. The invention, however, provides a hull conduit connection 7' which extends from an inlet opening 36 which is directly adjacent the opening 34 and below sea level to an outlet opening which connects into the interior cavity 8. By the provision of such a simple channel, the flow conditions within the sea chest 32 are vastly improved. The walls of the sea chest 32 may be straight and angular as indicated or may be curved, similar to that of the cavity 1 for the duct 10 in FIG. 2.

While specific embodiments of the invention have been shown and described in detail to illustrate the application of the principles of the invention, it will be understood that the invention may be embodied otherwise without departing from such principles.

What is claimed is:

1. A water craft having a hull with a bow and a stern, a throughgoing curved duct extending completely through said hull adjacent said blow and curved along its length rearwardly toward the stern from each side of said bow and terminating in a duct opening at each side of said hull located below the water line, propulsion means in said duct located centrally between the ends thereof for forcing sea water through said curved duct in a selected direction, and a conduit extending from each side of said hull below the water line directly into said curved duct at respective spaced locations from the curved duct openings and each said conduit having a conduit inlet opening below the water line located forwardly of the corresponding duct opening in a direction towards said bow, said conduits being substantially straight to provide a pressure equalizing flow through said conduits and into said curved duct to reduce turbulent flow in said curved duct adjacent each duct opening and to promote a pressure equalization and smooth flow through said curved duct.

2. A water craft according to claim 1, wherein said propulsion means comprises a rotatable drive motor and a propeller secured to said drive motor and rotatable thereby.

* * * * *